US008797244B2

(12) United States Patent
Lee et al.

(10) Patent No.: US 8,797,244 B2
(45) Date of Patent: Aug. 5, 2014

(54) DISPLAY DEVICE AND METHOD OF DRIVING THE SAME

(75) Inventors: Jun-Pyo Lee, Cheonan-si (KR); Jung-Hwan Cho, Goyang-si (KR)

(73) Assignee: Samsung Display Co., Ltd. (KR)

( * ) Notice: Subject to any disclaimer, the term of this patent is extended or adjusted under 35 U.S.C. 154(b) by 1374 days.

(21) Appl. No.: 12/243,384

(22) Filed: Oct. 1, 2008

(65) Prior Publication Data

US 2009/0207113 A1 Aug. 20, 2009

(30) Foreign Application Priority Data

Feb. 20, 2008 (KR) ..... 10-2008-0015417

(51) Int. Cl.
*G09G 3/36* (2006.01)

(52) U.S. Cl.
USPC ..... 345/87; 345/92; 345/204; 349/38

(58) Field of Classification Search
None
See application file for complete search history.

(56) References Cited

U.S. PATENT DOCUMENTS

| | | | | |
|---|---|---|---|---|
| 5,936,686 | A | 8/1999 | Okumura et al. | |
| 7,129,922 | B2 | 10/2006 | Shin | |
| 2004/0008170 | A1* | 1/2004 | Makino et al. | 345/87 |
| 2005/0088386 | A1 | 4/2005 | Kao et al. | |
| 2006/0145983 | A1* | 7/2006 | Lee et al. | 345/92 |
| 2006/0145987 | A1* | 7/2006 | Hong | 345/92 |
| 2006/0145988 | A1 | 7/2006 | Hsieh et al. | |
| 2006/0238476 | A1* | 10/2006 | Park et al. | 345/92 |
| 2006/0250537 | A1 | 11/2006 | Lee | |
| 2007/0064164 | A1* | 3/2007 | Tasaka et al. | 349/38 |
| 2008/0012807 | A1* | 1/2008 | Chiang et al. | 345/87 |
| 2008/0068516 | A1* | 3/2008 | Mori et al. | 348/790 |

FOREIGN PATENT DOCUMENTS

| | | | | |
|---|---|---|---|---|
| JP | 05119346 | | 5/1993 | |
| JP | 05119346 | A * | 5/1993 | G02F 1/136 |
| JP | 06138486 | | 5/1994 | |
| JP | 09265112 | * | 10/1997 | G02F 1/136 |
| JP | 11030789 | | 2/1999 | |
| JP | 2000241798 | | 9/2000 | |
| JP | 2002169180 | | 6/2002 | |
| JP | 2003222902 | | 8/2003 | |
| JP | 2004318072 | | 11/2004 | |
| JP | 2005274859 | | 10/2005 | |
| JP | 2006313349 | | 11/2006 | |
| KR | 100269849 | | 7/2000 | |
| KR | 1020040059665 | * | 7/2004 | G02F 1/133 |
| KR | 1020040060238 | | 7/2004 | |
| KR | 1020040110304 | | 12/2004 | |
| KR | 1020060115161 | | 11/2006 | |

(Continued)

*Primary Examiner* — Jesus Hernandez
(74) *Attorney, Agent, or Firm* — Cantor Colburn LLP

(57) ABSTRACT

A display device includes first and second pixels, first and second gate lines which transfer first and second gate-on voltages, respectively, to the first and second pixels in a first frame and a second frame, respectively, a first data line which transfers a first data voltage to the first pixel in the second frame and a second data line which transfers a second data voltage to the second pixel in the first frame. The first pixel stores the first data voltage as a first stored data voltage in response to the first gate-on voltage and discharges the first stored data voltage in response to the second gate-on voltage. The second pixel stores the second data voltage as a second stored data voltage in response to the second gate-on voltage and discharges the second stored data voltage in response to the first gate-on voltage.

21 Claims, 8 Drawing Sheets

(56) References Cited

FOREIGN PATENT DOCUMENTS

| | | | | | |
|---|---|---|---|---|---|
| KR | 1020070002419 | * | 1/2007 | ..... | G09G 3/36 |
| KR | 1020070059292 | | 6/2007 | | |
| KR | 1020070070766 | | 7/2007 | | |
| KR | 1020070079143 | | 8/2007 | | |

* cited by examiner

DISPLAY DEVICE AND METHOD OF DRIVING THE SAME

This application claims priority to Korean Patent Application No. 10-2008-0015417, filed on Feb. 20, 2008, and all the benefits accruing therefrom under 35 U.S.C. §119, the contents of which in its entirety are herein incorporated by reference.

BACKGROUND OF THE INVENTION (a) Field of the Invention

The present invention relates to a display device and a method of driving the same. More particularly, the present invention relates to a display device and method of driving the same in which a blur phenomenon is effectively prevented from be generating on a screen of the display device.

(b) Description of the Related Art

In general, a display device, such as a liquid crystal display or an organic light emitting display, is a hold type display device. Specifically, the hold type display device displays an image by receiving and storing data, in a row-by-row manner, in pixels of a plurality of pixels arranged in a matrix form.

More specifically, the liquid crystal display includes a first display panel on which pixel electrodes are provided, a second display panel on which a common electrode is provided, and a liquid crystal layer interposed between the first display panel and the second display panel. The pixel electrodes are arranged in a substantially matrix form and are each connected to a switching element, such as a thin film transistor, for example, to sequentially receive a data voltage row by row. The common electrode receives a common voltage. A pixel electrode, the common electrode, and the liquid crystal layer interposed therebetween constitute a liquid crystal capacitor, and the liquid crystal capacitor stores a data voltage applied thereto. The liquid crystal display generates an electric field in the liquid crystal layer between the pixel electrode and the common electrode by applying the data voltage to the pixel electrode and the common voltage to the common electrode. Thus, a transmittance of light passing through the liquid crystal layer is adjusted based on the electric field, and a desired image is thereby displayed.

Each pixel of the hold type of display device displays stored data for a current frame until data for a next frame is received. When the hold type display device displays an image of a moving object on a screen of the display device, however, a blur phenomenon, in which a border portion of the moving object is blurred, thereby deteriorating a picture quality of the display device.

BRIEF SUMMARY OF THE INVENTION

Exemplary embodiments of the present invention have been made in an effort to provide a display device, and a method of driving the same, having advantages which include, for example, of preventing a blur phenomenon from generating on a screen.

An exemplary embodiment of the present invention provides a display device including: a first pixel; a second pixel adjacent to the first pixel; a first gate line which transfers a first gate-on voltage to the first pixel and the second pixel in a first frame; a second gate line which transfers a second gate-on voltage to the first pixel and the second pixel in a second frame chronologically subsequent and adjacent to the first frame; and a data line which transfers a first data voltage to the first pixel and the second pixel in the first frame and a second data voltage to the first pixel and the second pixel the second frame. The first pixel stores the first data voltage as a first stored data voltage in response to the first gate-on voltage and discharges the first stored data voltage in response to the second gate-on voltage. The second pixel stores the second data voltage as a second stored data voltage in response to the second gate-on voltage and discharges the second stored data voltage in response to the first gate-on voltage.

The display device may further include a plurality of the first gate lines, a plurality of the second gate lines and a display panel on which the plurality of first gate lines and the plurality of second gate lines are disposed. First gate lines of the plurality of first gate lines and second gate lines of the plurality of second gate lines may be disposed on the display panel in an alternating positions.

The first pixels and the second pixels may be alternately arranged in a row direction and in a column direction.

The display device may further include a plurality of the first pixels disposed on the display substrate and a plurality of the second pixels disposed on the display substrate. First pixels of the plurality of first pixels and second pixels of the plurality of second pixels are arranged in a matrix pattern, and the first pixels and the second pixels are arranged alternately in both a row direction and in a column direction on the display substrate.

First pixels of the plurality of first pixels and second pixels of the plurality of second pixels may be arranged alternately in a column direction.

One of the first pixel and the second pixel may include a first switching element which transfers one of the first data voltage and the second data voltage in response to one of the first gate-on voltage and the second gate-on voltage, a capacitor which stores the one of the first data voltage and the second data voltage transferred from the first switching element, and a second switching element which discharges the one of the first data voltage and the second data voltage stored in the capacitor in response to one of the second gate-on voltage and the first gate-on voltage.

The capacitor may include a pixel electrode which receives the one of the first data voltage and the second data voltage from the first switching element, a common electrode which receives a common voltage, and a liquid crystal layer formed between the pixel electrode and the common electrode.

The second switching element may include a first terminal connected to the pixel electrode and a second terminal which receives the common voltage.

The second switching element may include a first terminal connected to the pixel electrode and a second terminal connected to the common electrode.

The one of the first pixel and the second pixel may further include a signal line, the signal line and the pixel electrode forming the capacitor, and the second switching element may comprise a first terminal connected to the pixel electrode and a second terminal connected to the signal line.

The first frame and the second frame may be alternately repeated.

An alternative exemplary embodiment of the present invention provides a display device including: a first pixel and a second pixel; a first gate line which transfers a first gate-on voltage to at least one of the first pixel and the second pixel in a first frame; a second gate line that transfers a second gate-on voltage to the at least one of the first pixel and the second pixel in a second frame chronologically subsequent and adjacent to the first frame; a first data line which transfers a first data voltage to the at least one of the first pixel and the second pixel in the first frame; and a second data line which transfers a second data voltage to the at least one of the first pixel and the second pixel in the second frame. The first pixel represents a gray voltage level corresponding to the first data voltage in response to the second gate-on voltage and represents a black voltage level in response to the first gate-on voltage. The second pixel represents a gray voltage level corresponding to the second data voltage in response to the first gate-on voltage and represents a black voltage level in response to the second gate-on voltage.

The first pixel may include: a first switching element including a control terminal connected to the second gate line, a first terminal connected to the first data line, and a second terminal; a first pixel electrode connected to the second terminal of the first switching element; a first common electrode to which a common voltage is applied; and a second switching element which includes a control terminal connected to the first gate line, a second terminal connected to the pixel electrode, and a second terminal which receives the common voltage. Further, the second pixel may include: a third switching element including a control terminal connected to the first gate line, a first terminal connected to the second data line, and a second terminal; a second pixel electrode connected to the second terminal of the third switching element; a second common electrode to which a common voltage is applied; and a fourth switching element including a control terminal connected to the second gate line, a second terminal connected to the second pixel electrode, and a second terminal which receives the common voltage.

The second terminal of the second switching element may be connected to the first common electrode, and the second terminal of the fourth switching element may be connected to the second common electrode.

The first pixel may further include a first signal line, the first signal line and the first pixel electrode forming a storage capacitor, and the second terminal of the second switching element may be connected to the signal line. Further, the second pixel may further include a second signal line, the second signal line and the second pixel electrode forming a storage capacitor, and the second terminal of the fourth switching element may be connected to the second signal line.

The display device may further include: a third pixel; a fourth pixel; and a third gate line which transfers a third gate-on voltage to at least one of the third pixel and the fourth pixel in the first frame. The third pixel represents a gray voltage level corresponding to the first data voltage in response to the third gate-on voltage and represents a black voltage level in response to the second gate-on voltage. The fourth pixel represents a gray voltage level corresponding to the second data voltage in response to the second gate-on voltage and represents a black voltage level in response to the third gate-on voltage.

The second gate line may be formed between the first gate line and third gate line.

The first frame and the second frame are alternately repeated.

Yet another alternative exemplary embodiment of the present invention provides a method of driving a display device including a first pixel, a second pixel, a third pixel and a fourth pixel arranged in a matrix form.

The method includes: outputting a first gate-on voltage to the first pixel, the second pixel, the third pixel and the fourth pixel in a first frame; storing data in the second pixel and the third pixel in response to the first gate-on voltage; discharging data stored in the first pixel and the fourth pixel in response to the first gate-on voltage; displaying an image corresponding to data stored in the second pixel and the third pixel; outputting a second gate-on voltage to the first pixel, the second pixel, the third pixel and the fourth pixel in second frame chronologically subsequent and adjacent to the first frame; storing data in the first pixel and the fourth pixel in response to the second gate-on voltage; discharging data stored in the second pixel and the third pixel in response to the second gate-on voltage; and displaying an image corresponding to data stored in the first pixel and the fourth pixel.

The display device may further include a plurality of the first pixels, a plurality of the second pixels, a plurality of the third pixels and a plurality of the fourth pixels. First pixels of the plurality of first pixels and third pixels of the plurality of third pixels may be alternately arranged in a column direction, and second pixels of the plurality of second pixels and fourth pixels of the plurality of fourth pixels may be alternately arranged in a column direction.

The first pixels and the second pixels may be alternately arranged in a row direction, and the third pixels and the fourth pixels may be alternately arranged in a row direction.

The first frame and the second frame are alternately repeated.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
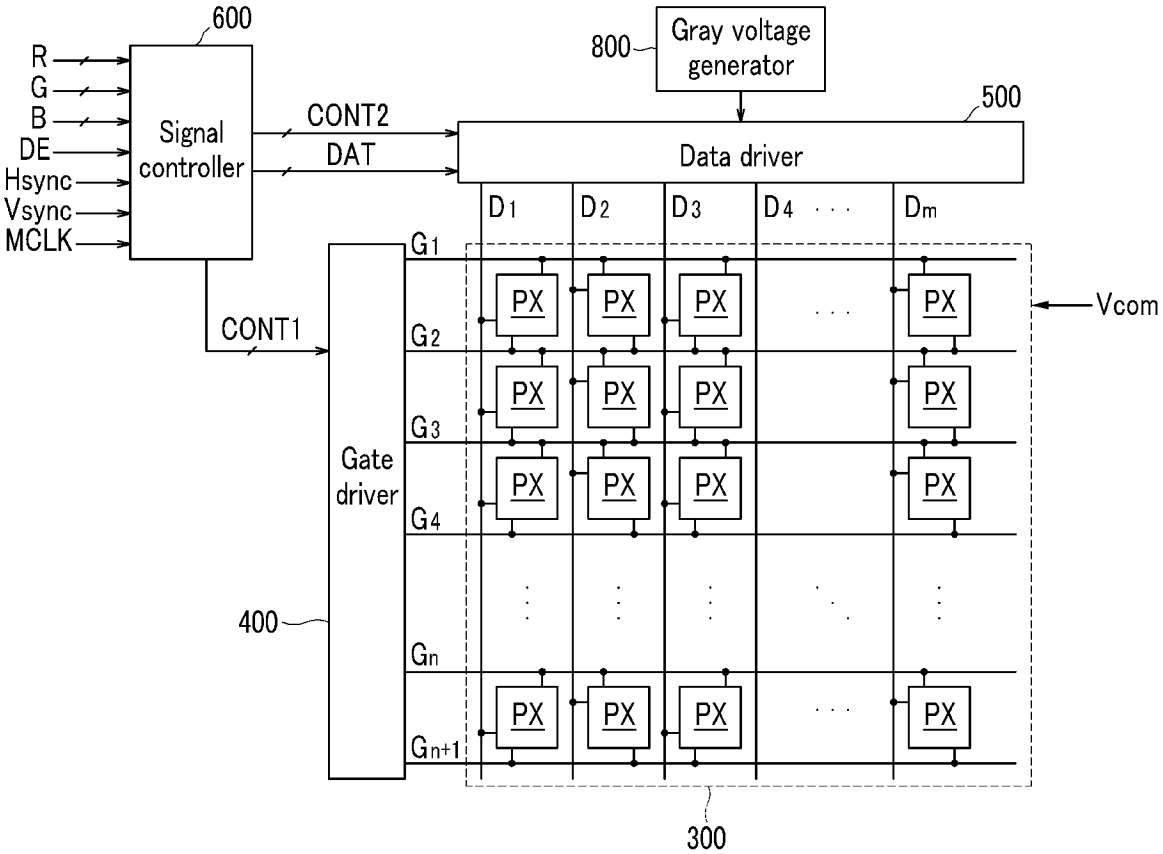
FIG. 1 is a block diagram of a liquid crystal display according to an exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

A display device and a method of driving the same according to exemplary embodiments of the present invention will hereinafter be described in further detail with reference to the accompanying drawings.

A display device according to an exemplary embodiment of the present invention will now be described in further detail with reference to FIG. 1 to FIG. 3. In an exemplary embodiment of the present invention, a liquid crystal display is described as an example of a display device, but alternative exemplary embodiments are not limited thereto.

Figure 2:
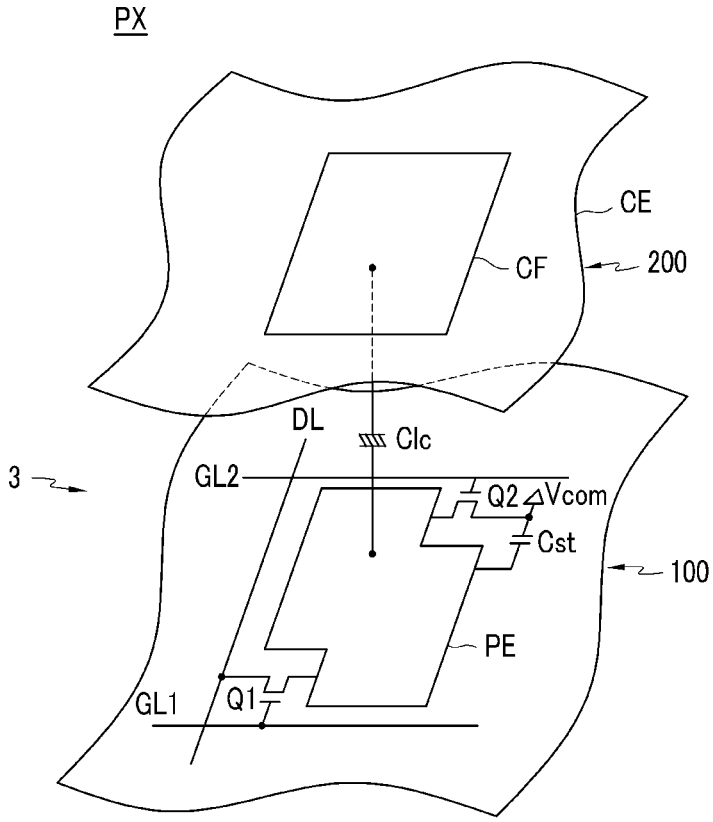
FIG. 2 is an equivalent circuit diagram of a pixel in a liquid crystal display according to an exemplary embodiment of the present invention.
Figure 3:
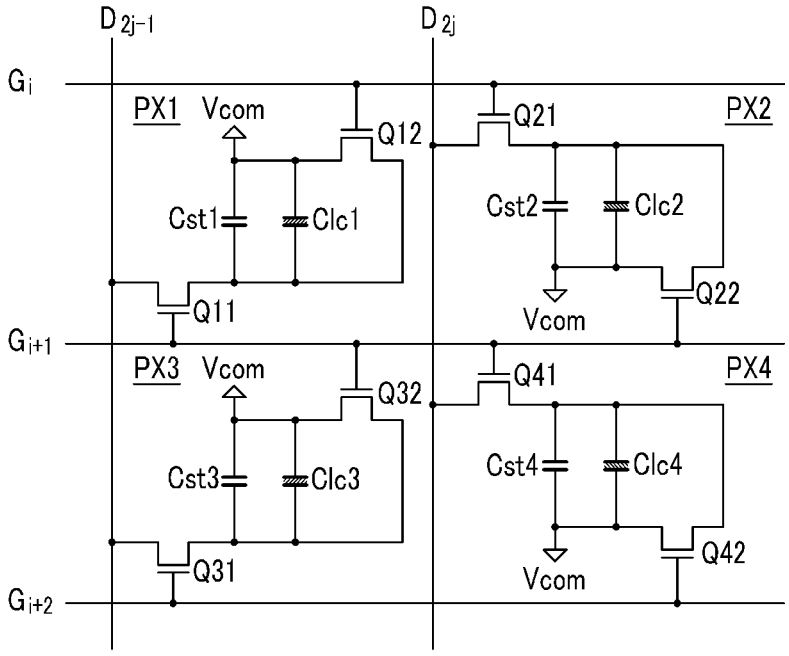
FIG. 3 is a schematic circuit diagram of four (4) pixels in a liquid crystal display according to an exemplary embodiment of the present invention.

FIG. 1 is a block diagram of a liquid crystal display according to an exemplary embodiment of the present invention, FIG. 2 is an equivalent circuit diagram of a pixel in a liquid crystal display according to an exemplary embodiment of the present invention, and FIG. 3 is a schematic circuit diagram of four (4) pixels in a liquid crystal display according to an exemplary embodiment of the present invention.

Referring to FIG. 1, the liquid crystal display according to an exemplary embodiment of the present invention includes a liquid crystal panel assembly 300, a gate driver 400, a data driver 500, a gray voltage generator 800 and a signal controller 600.

The liquid crystal panel assembly 300 includes a plurality of signal lines $G_1$-$G_{n+1}$ and $D_1$-$D_m$ and a plurality of pixels PX connected the plurality of signal lines $G_1$-$G_{n+1}$ and $D_1$-$D_m$ and are arranged in a substantially matrix form, as shown in FIG. 1. As shown in FIG. 2, the liquid crystal panel assembly 300 includes a lower panel 100 and an upper panel 200 disposed opposite to, e.g., facing, the lower panel 100, and a liquid crystal layer 3 interposed therebetween.

The plurality of signal lines $G_1$-$G_{n+1}$ and $D_1$-$D_m$ includes a plurality of gate lines $G_1$-$G_{n+1}$ which transfers a gate signal, e.g., a scanning signal, and a plurality of data lines $D_1$-$D_m$ which transfers a data voltage. Gate lines $G_1$-$G_{n+1}$ of the plurality of gate lines $G_1$-$G_{n+1}$ extend substantially in a first direction, e.g., a substantially horizontal or row direction as shown in FIG. 1, and are substantially parallel to each other. Data lines $D_1$-$D_m$ of the plurality of data lines $D_1$-$D_m$ extend in a second direction perpendicular to the first direction, e.g., a vertical or column direction as shown in FIG. 1, and are approximately parallel to each other. A quantity "m" of the data lines $D_1$-$D_m$ is equal to a quantity of pixel PX columns. A quantity "n+1" of the gate lines $G_1$-$G_{n+1}$ is greater by 1 than a quantity of pixel PX rows.

Referring to FIG. 2, each pixel PX of the plurality of pixels PX includes a first switching element Q1 and a second switching element Q2 (hereinafter collectively referred to as "two switching elements Q1 and Q2"). In an exemplary embodiment of the present invention, the first switching element Q1 is a writing switching element Q1 and the second switching element Q2 is an erasing switching element Q2.

As shown in FIG. 2, the first switching element Q1 and the second switching element Q2 are connected to a first gate line GL1 and an adjacent second gate line GL2, respectively. The first switching element Q1 is connected to a data line DL, and both of the first switching element Q1 and the second switching element Q2 are connected to a liquid crystal capacitor Clc and a storage capacitor Cst via a pixel electrode PE. In an alternative exemplary embodiment of the present invention, the storage capacitor Cst may be omitted.

The two switching elements Q1 and Q2 are three terminal elements such as a thin film transistor ("TFT") provided in the lower panel 100. As described above, the switching element Q1 according to an exemplary embodiment is a writing switching element Q1 which transfers a data voltage to the liquid crystal capacitor Clc and the storage capacitor Cst, and the switching element Q2 according to an exemplary embodiment is an erasing switching element Q2 which deletes, e.g., erases, a voltage, such as the data voltage, of the liquid crystal capacitor Clc and the storage capacitor Cst.

Still referring to FIG. 2, a control terminal of the writing switching element Q1 is connected to the first gate line GL1, an input terminal thereof is connected to the data line DL and an output terminal thereof is connected to the liquid crystal capacitor Clc and the storage capacitor Cst via the pixel electrode PE. A control terminal of the erasing switching element Q2 is connected to the second gate line GL2, an input terminal thereof is connected to a common voltage Vcom and the storage capacitor Cst, and an output terminal thereof is connected to the liquid crystal capacitor Clc and the storage capacitor Cst via the pixel electrode PE. In an exemplary embodiment of the present invention, the common voltage Vcom is a ground voltage, but alternative exemplary embodiments are not limited thereto.

The liquid crystal capacitor Clc includes the pixel electrode PE of the lower panel 100 and a common electrode CE of the upper panel 200 as terminals thereof, and the liquid crystal layer 3 between the pixel electrode PE and the common electrode CE as a dielectric material. As described above, the pixel electrode PE is connected to the switching elements Q1 and Q2.

In an exemplary embodiment the common electrode CE is formed on an entire surface of the upper panel 200 and receives the common voltage Vcom. In an alternative exemplary embodiment, however, the common electrode CE may be provided on the lower panel 100. In this case, at least one of the pixel electrode PE and the common electrode CE may be formed in a substantially linear or bar shape, and an input terminal of the erasing switching element Q2 may be connected to the common electrode CE.

The storage capacitor Cst assists the liquid crystal capacitor Clc and is formed by an overlap of a separate signal line (not shown) and the pixel electrode PE provided on the lower panel 100 with an insulator interposed therebetween. A predetermined voltage such as the common voltage Vcom is applied to the separate signal line, and an input terminal of the erasing switching element Q2 may be connected to the separate signal line.

To represent color display, each pixel PX displays one of a set of primary colors (spatial division) or, alternatively, sequentially and alternately displays each of the primary colors of the set of primary colors (temporal division). Thus, a desired color is displayed by the spatial or temporal combination of the primary colors. The set of the primary colors includes red, green and blue colors. FIG. 2 shows an exemplary embodiment utilizing spatial division, e.g., in which each pixel PX is provided with a color filter CF for representing one of the primary colors in a region of the upper panel 200 corresponding to the pixel electrode PE. In an alternative exemplary embodiment, the color filter CF may be provided on or, alternatively, under the pixel electrode PE of the lower panel 100.

At least one polarizer (not shown) is provided at the liquid crystal panel assembly 300 (FIG. 1).

As will be described in greater detail below with reference to FIG. 3, connections between the two switching elements Q1 and Q2 of a given pixel PX, the data line DL, the first gate line GL1 and the second GL2 are substantially the same for each pixel PX within each column of pixels PX, but are different in pixels PX within each row of pixels PX.

Specifically, in an odd-numbered column of pixels PX, for example, a writing switching element Q1 of a given pixel PX is connected to a next gate line positioned at a lower side of the given pixel PX and a data line, while an erasing switching element Q2 is are connected to a previous gate line positioned at an upper side of the given pixel PX. In contrast, in an even-numbered column of pixels PX, a writing switching element Q1 is connected to a previous gate line and a data line, while an erasing switching element Q2 is connected to a next gate line.

The abovementioned connections will now be described in further detail with reference to FIG. 3. In FIG. 3, four (4) pixels PX are shown. Specifically, a first pixel PX1 and a third pixel PX3 (of a given column of pixels PX) and a second pixel PX2 and a fourth pixel PX4 (of an adjacent given column of pixels) are shown. For clarification, individual switching elements of the switching elements Q1 and Q2 for a given pixel PX are denoted using a form "Qxy", where "x" is a pixel number (e.g., 1, 2, 3 or 4) and "y" indicates whether the switching element is a writing switching element (denoted by a "1") or an erasing switching element (denoted by a "2"). Thus, the erasing switching Q2 element of the third pixel PX3, for example, is labeled as "Q32" in FIG. 3.

Referring to FIG. 3, a writing switching element Q11 of the first pixel PX1 positioned at an i-th (i=1, 2, . . . , n) row and a (2j−1)-th (j=1, 2, . . . , m/2, where m is an even number) column is connected to a next gate line, e.g., an (i+1)-th gate line $G_{i+1}$ (positioned at a lower portion of the first pixel PX1) and a data line $D_{2j-1}$. An erasing switching element Q12 of the first pixel PX1 is connected to a previous gate line positioned at an upper portion of the first pixel PX1, e.g., an i-th gate line $G_i$.

Likewise, a writing switching element Q31 of the third pixel PX3 positioned in the same column as the first pixel PX1, e.g., the pixel PX3 positioned at an (i+1)-th row and the (2j−1)-th column, is connected to a next gate line $G_{i+2}$ and the data line $D_{2j-1}$. An erasing switching element Q32 of the third pixel PX3 is connected to a previous gate line $G_{i+1}$.

A writing switching element Q21 of the second pixel PX2 positioned at a same row as the pixel PX1, e.g., the i-th row and a 2j-th column, is connected to the previous gate line $G_i$ and a data line $D_{2j}$, and an erasing switching element Q2 thereof is connected to the next gate line $G_{i+1}$.

Further, a writing switching element Q41 of the fourth pixel PX4 positioned at the (i+1)-th row and the 2j-th column is connected to a previous gate line $G_{i+1}$ and the data line $D_{2j}$, and an erasing switching element Q42 thereof is connected to the next gate line $G_{i+2}$.

In FIG. 3, Clcp and Cstp (where p=1, 2, 3 or 4) indicate the liquid crystal capacitor and a storage capacitor, respectively, of a given pixel PX corresponding to a respective one of the first pixel PX1, the second pixel PX2, the third pixel PX3 and the fourth pixel PX4. Thus, the storage capacitor associated with the second pixel PX2, for example, is designated as "Cst2" in FIG. 3.

Referring again to FIG. 1, the gray voltage generator 800 generates all gray voltages or, alternatively, a limited quantity of, e.g., less than all, gray voltages (hereinafter referred to as "reference gray voltages") related to transmittance properties of the pixel PX. The reference gray voltages have positive values and negative values (relative to the common voltage Vcom).

The gate driver 400 is connected to the gate lines $G_1$-$G_{n+1}$ of the liquid crystal panel assembly 300 to apply a gate signal including a gate-on voltage Von and a gate-off voltage Voff to the gate lines $G_1$-$G_{n+1}$.

The data driver 500 is connected to the data lines $D_1$-$D_m$ of the liquid crystal panel assembly 300. The data driver 500 selects a reference gray voltage from the gray voltage generator 800, and applies the reference gray voltage as a data voltage to the data lines $D_1$-$D_m$. However, when the gray voltage generator 800 provides only the limited quantity of reference gray voltages, e.g., when the gray voltage generator 800 does not provide all reference gray voltages, the data driver 500 generates a desired data voltage by dividing a reference gray voltage.

The signal controller 600 controls the gate driver 400 and the data driver 500.

Each of the gate driver 400, the data driver 500, the signal controller 600 and the gray voltage generator 800 may be directly mounted on the liquid crystal panel assembly 300 in at least one IC chip form, for example, or, alternatively, may be mounted on a flexible printed circuit film (not shown) and thereafter attached to the liquid crystal panel assembly 300 in a tape carrier package ("TCP") form. In another alternative exemplary embodiment, any or all of the abovementioned components may be mounted on a separate printed circuit board ("PCB") (not shown). Alternatively, the gate driver 400, the data driver 500, the signal controller 600 and the gray voltage generator 800, together with the signal lines $G_1$-$G_{n+1}$ and $D_1$-$D_m$ and the thin film transistor switching elements Q1 and/or Q2, may be integrated into the liquid crystal panel assembly 300. Further, the gate driver 400, the data driver 500, the signal controller 600 and the gray voltage generator 800 may be integrated into a single chip and, in this case, at least one of the gate driver 400, the data driver 500, the signal controller 600 and the gray voltage generator 800, or at least one circuit element thereof and/or one circuit element including each of the gate driver 400, the data driver 500, the signal controller 600 and the gray voltage generator 800, may be disposed outside of a single chip, e.g., on multiple chips.

An operation of the liquid crystal display will now be described in further detail with reference to FIG. 4 to FIG. 7.

Figure 4:
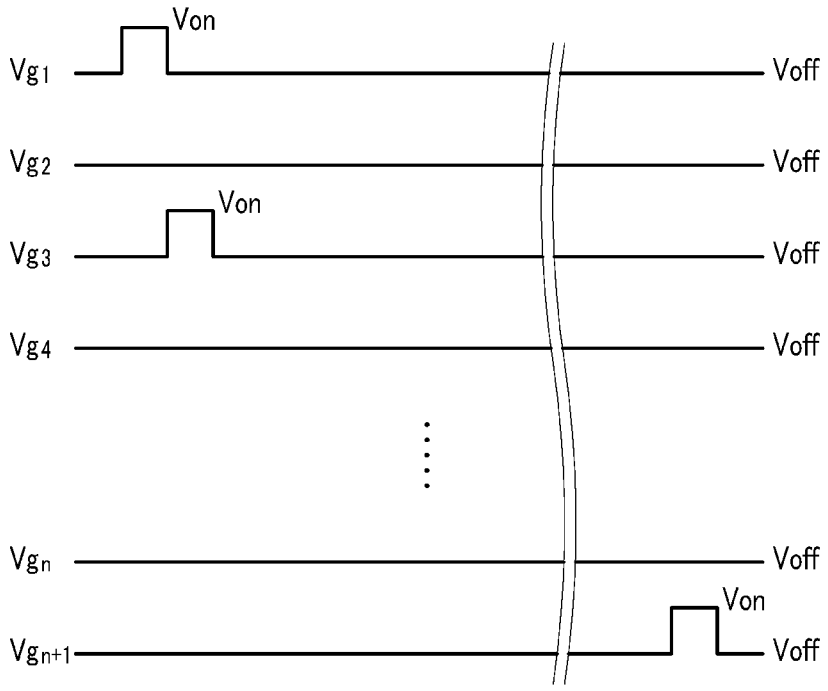
FIG. 4 and FIG. 6 are waveform timing diagrams of gate signals in odd-numbered frames and even-numbered frames, respectively, in a liquid crystal display according to an exemplary embodiment of the present invention.
Figure 5:
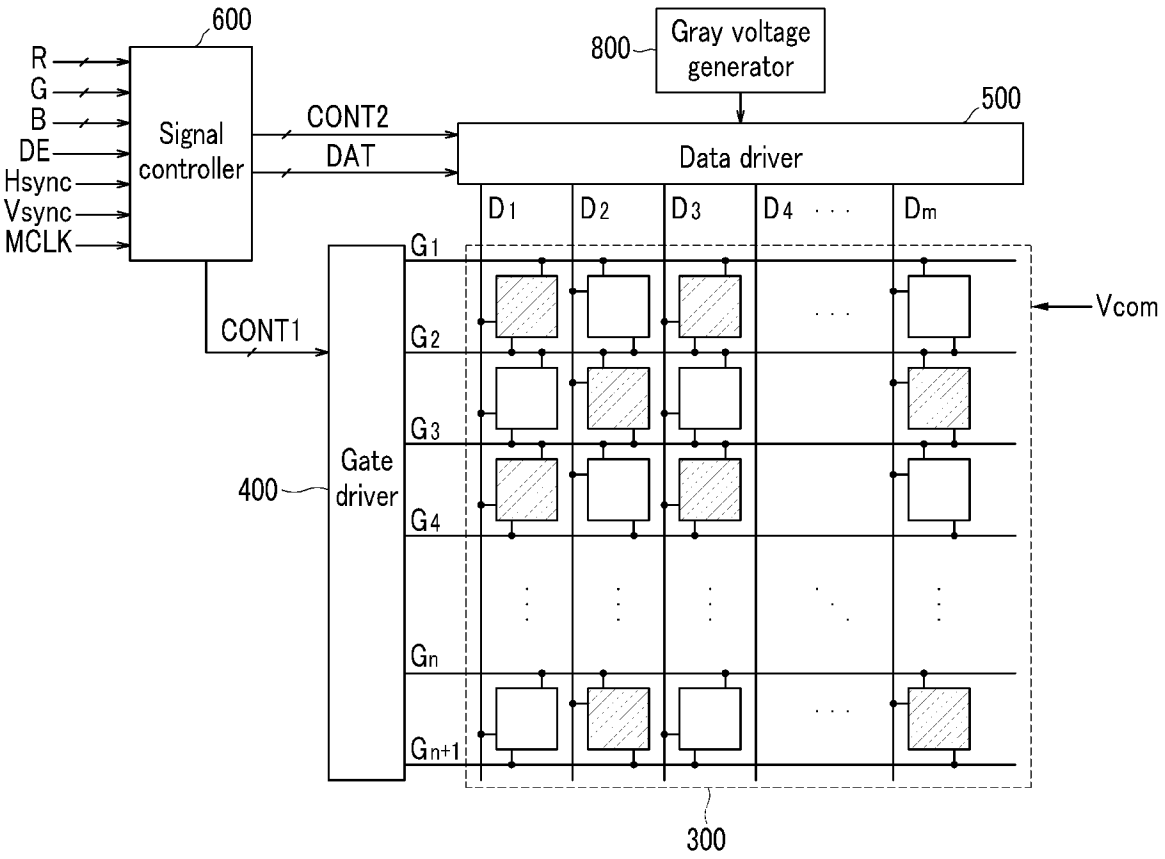
FIG. 5 and FIG. 7 are block diagrams of a liquid crystal display illustrating image display states according to the gate signals shown in FIG. 4 and FIG. 6, respectively.
Figure 6:
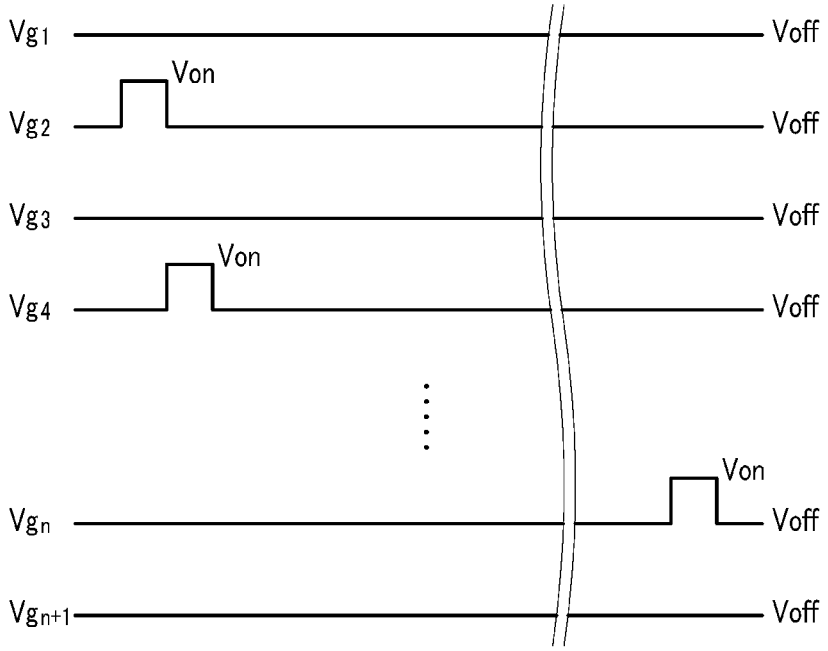
Figure 7:
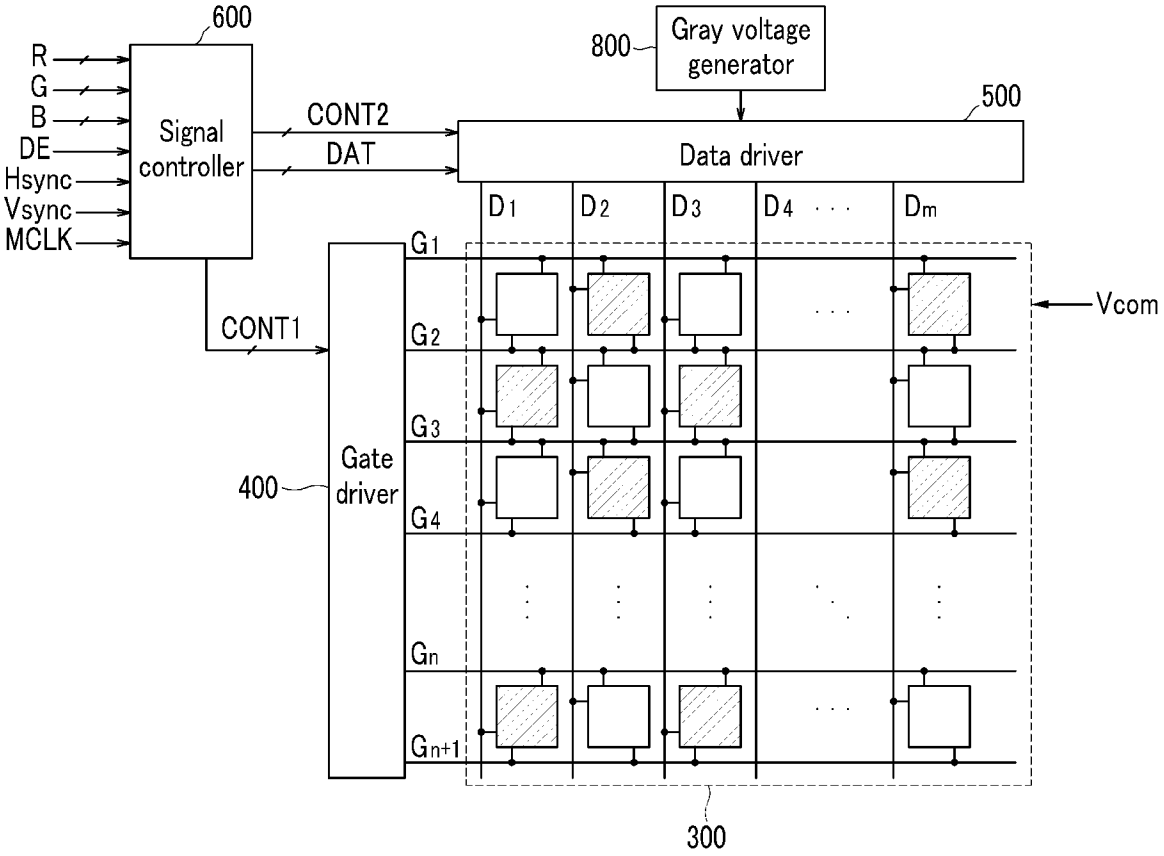

FIG. 4 and FIG. 6 are waveform timing diagrams of gate signals in an odd-numbered frame and an even-numbered frame, respectively, in a liquid crystal display according to an exemplary embodiment of the present invention, and FIG. 5 and FIG. 7 are block diagrams of a liquid crystal display illustrating an image display state according to the gate signals shown in FIG. 4 and FIG. 6, respectively.

The signal controller 600 receives input image signals R, G and B and an input control signal for controlling the display of the input image signals R, G and B from an external graphic controller (not shown). The input image signals R, G and B contain luminance information for each pixel PX, and the luminance information has reference gray voltages of a given quantity, for example, $1024=2^{10}$, $256=2^8$ or $64=2^6$. The input control signal according to an exemplary embodiment includes, for example, a vertical synchronization signal Vsync, a horizontal synchronizing signal Hsync, a main clock signal MCLK and a data enable signal DE, but alternative exemplary embodiments of the present invention are not limited thereto.

The signal controller 600 processes the input image signals R, G and B based on an operating condition of the liquid crystal panel assembly 300 according to the input image signals R, G and B and the input control signal, and thereafter generates a gate control signal CONT1 and a data control signal CONT2. The signal controller 600 then sends the gate control signal CONT1 to the gate driver 400, and sends the data control signal CONT2 and a processed image signal DAT to the data driver 500. In an exemplary embodiment, the signal controller 600 transfers an input image signal corresponding to one screen for two consecutive frames (e.g., an odd-numbered frame and then an even-numbered frame). Further, the image signal DAT according to an exemplary embodiment is a digital image signal DAT.

The gate control signal CONT1 includes a scanning start signal for instructing the scanning start to odd-numbered gate lines $G_1, G_3, \ldots, G_{n+1}$, a scanning start signal for instructing the scanning start to even-numbered gate lines $G_2, G_4, \ldots, G_n$, and at least one clock signal for controlling an output period of a gate-on voltage Von. The gate control signal CONT1 may further include an output enable signal OE for limiting a duration time of a gate-on voltage Von.

The data control signal CONT2 according to an exemplary embodiment includes a horizontal synchronization start signal STH1 (not shown) for notifying a transmission start of a the image signal DAT for one row (set) of pixels PX, a load signal LOAD (not shown) for applying an analog data voltage to the data lines $D_1$-$D_m$, and a data clock signal HCLK (not shown). The data control signal CONT2 may further include an inversion signal RVS (not shown) for inverting a polarity of a data voltage with respect to the common voltage Vcom (hereinafter, "polarity of a data voltage with respect to the common voltage Vcom" is referred to as a "polarity of a data voltage").

In operation, the data driver 500 receives a digital image signal DAT for one row (set) of pixels PX based on the data control signal CONT2 from the signal controller 600, selects a reference gray voltage corresponding to each digital image signal DAT, thereby converting the digital image signal DAT to an analog data voltage, and then applies the analog data voltage to corresponding data lines $D_1$-$D_m$.

Now, a display operation of the liquid crystal display in an odd-numbered, e.g., first, frame will be described in further detail with reference to FIG. 4 and FIG. 5.

Referring to FIG. 4 and FIG. 5, in the odd-numbered frame, the gate driver 400 sequentially applies gate signals $V_{g1}$, $V_{g3}, \ldots, V_{gn+1}$ having the gate-on voltage Von to odd-numbered gate lines $G_1, G_3, \ldots, G_{n+1}$ according to the gate control signal CONT1 supplied from the signal controller 600 to the gate driver 400, thereby turning on associated switching elements Q1 and Q2 (FIG. 3) connected to the gate lines $G_1, G_3, \ldots, G_{n+1}$. At the same time, the gate driver 400 sustains a voltage level of the gate signals $Vg_2, Vg_4, \ldots, Vg_n$ for even-numbered gate lines $G_2, G_4, \ldots, G_n$ at the gate-off voltage Voff, as shown in FIG. 4. Accordingly, pixels PX including a writing switching element Q1 having a control terminal thereof connected to the odd-numbered gate lines $G_1, G_3, \ldots, G_{n+1}$, e.g., pixels PX in odd-numbered rows and even-numbered columns, and pixels PX in even-numbered rows and odd-numbered columns, receive the data voltages through data lines $D_1$-$D_m$.

A voltage difference between the data voltage and the common voltage Vcom applied to each pixel PX is a charge voltage, e.g., a pixel voltage of the liquid crystal capacitor Clc. An orientation of liquid crystal molecules in the liquid crystal layer 3 (FIG. 2) changes based on a magnitude of the voltage difference, and a polarization of light passing through the liquid crystal layer 3 is thereby controlled. The change in the polarization is represented by a change in transmittance of light through a polarizer (not shown), and the pixel PX thereby displays a luminance representing a reference gray voltage of corresponding to the image signal DAT. Therefore, the pixels PX in odd-numbered rows and even-numbered columns, as well as pixels PX in even-numbered rows and odd-numbered columns display an image based on reference gray voltages according to the image signal DAT. For clarification, pixels PX which display the image (e.g., the pixels PX in odd-numbered rows and an even-numbered columns, and pixels PX in even-numbered rows and an odd-numbered columns) are not shaded in FIG. 5.

In pixels PX having a writing switching element Q1 connected to an even-numbered gate line $G_2, G_4, \ldots, G_n$, e.g., pixels PX in odd-numbered rows and odd-numbered columns, as well as pixels PX in even-numbered rows and even-numbered columns, an erasing switching element Q2 therein is turned on. Accordingly, the common voltage Vcom is applied to the liquid crystal capacitor Clc and the storage capacitor Cst (each having a terminal connected to the common voltage Vcom through erasing switching element Q2, turned on by the gate-on voltage Von of the odd-numbered gate lines $G_1, G_3, \ldots, G_{n+1}$). Accordingly, because a voltage difference is not generated at opposite ends of the liquid crystal capacitor Clc, e.g., across the liquid crystal layer 3 (FIG. 2), corresponding pixels PX do not transmit, and thereby display a black color (shown as shaded pixels PX in FIG. 5).

A display operation of a liquid crystal display in an even-number frame, temporally subsequent and adjacent to the odd-number frame described in greater detail above with reference to FIGS. 4 and 5, will hereinafter be described in further detail with reference to FIG. 6 and FIG. 7.

Referring to FIG. 6 and FIG. 7, in the even-numbered frame, the gate driver 400 sequentially applies gate signals $Vg_2, Vg_4, \ldots, Vg_n$ having the gate-on voltage Von to even-numbered gate lines $G_2, G_4, \ldots, G_n$ based on the gate control signal CONT1 from the signal controller 600, thereby turning on switching elements Q1 and Q2 connected to the gate lines $G_2, G_4, \ldots, G_n$. The gate driver 400 sustains a voltage level of gate signals $Vg_1, Vg_3, \ldots, Vg_{n+1}$ applied to the odd-numbered gate lines $G_1, G_3, \ldots, G_{n+1}$ at the gate-off voltage Voff. Accordingly, a writing switching element Q1 having a control terminal connected to the even-numbered gate lines $G_2, G_4, \ldots, G_n$ is turned on to transfer the data voltages from data lines $D_1$-$D_m$. Therefore, pixels PX in odd-numbered rows and odd-numbered columns, as well as pixels PX in even-numbered rows and even-numbered columns receive the data voltages to display an image based on a luminance representing reference gray voltages of the image signal DAT.

However, in pixels PX having writing switching elements Q1 connected to odd-numbered gate lines $G_1, G_3, \ldots, G_{n+1}$, e.g., pixels PX in odd-numbered rows and even-numbered columns, as well as pixels PX in even-numbered rows and odd-numbered columns, an erasing switching element Q2 is turned on by the gate-on voltage Von applied thereto from the even-numbered gate lines $G_2, G_4, \ldots, G_n$. Accordingly, because the pixels PX in odd-numbered rows and even-numbered columns, as well as pixels PX in even-numbered rows and odd-numbered columns do not transmit light, the pixels PX in odd-numbered rows and even-numbered columns, as well as pixels PX in even-numbered rows and odd-numbered columns display a black color (as indicated by shading in FIG. 7).

As a result, the liquid crystal display according to an exemplary embodiment of the present invention displays an entire screen by displaying a first half of the screen in an odd-numbered frame and displaying second half of the screen in a temporally subsequent and adjacent even-numbered frame. Therefore, a duration time of a gate-on voltage can be set to be long, relative to a display device of the prior art, even when a frequency of a vertical synchronization signal is approximately 60 Hz, approximately 120 Hz, or more, for example. Thus, a pixel PX which displays an image based on an applied data voltage in an odd frame discharges a stored data voltage in a subsequent even frame, and thus displays a black color image in the subsequent even frame, thereby substantially decreasing and/or effectively removing, e.g., eliminating, a blur phenomenon generated if the stored image is not discharged.

A liquid crystal display according to an alternative exemplary embodiment of the present invention will now be described in further detail with reference to FIG. 8.

Figure 8:
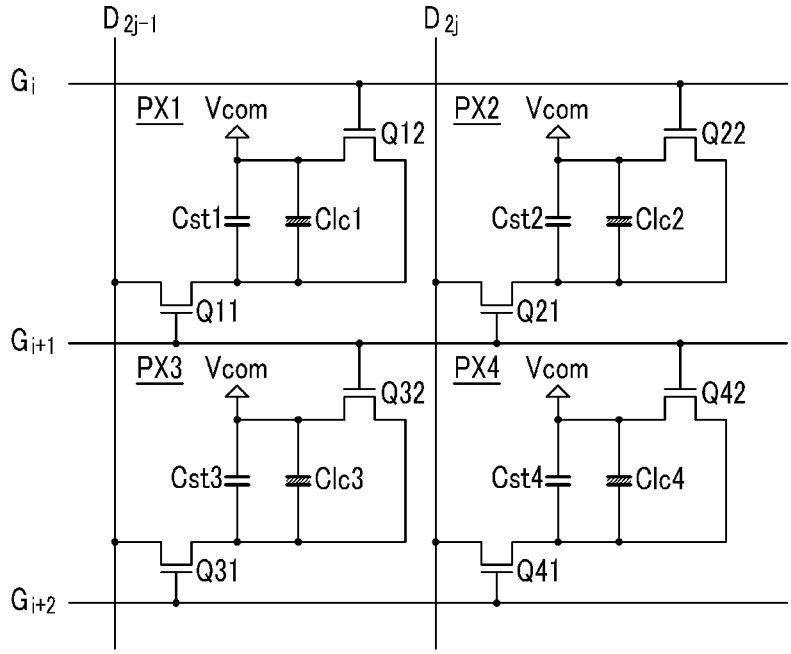
FIG. 8 is a schematic circuit diagram of four (4) pixels in a liquid crystal display according to an alternative exemplary embodiment of the present invention.

FIG. 8 is a schematic circuit diagram of four (4) pixels in a liquid crystal display according to an alternative exemplary embodiment of the present invention. In FIG. 8, the same reference characters denote the same or like components as described above in further detail with reference to FIG. 3, and any repetitive detailed description thereof has been omitted.

Referring to FIG. 8, a pixel PX of a liquid crystal display according to an alternative exemplary embodiment of the present invention a structure substantially the same as a structure of the pixel PX described above in greater detail and shown in FIG. 2, except a control terminal of a writing switching element Q1 of each of a first pixels PX1, a second pixel PX2, a third pixel PX3 and a fourth pixel PX4 are connected to a next gate line $G_{i+1}$ of two adjacent subsequent gate lines $G_i$ and $G_{i+1}$. Therefore, any repetitive detailed description thereof has hereinafter been omitted.

As shown in FIG. 8, control terminals of writing switching elements Q11 and Q21 of pixels PX1 and PX2, respectively, positioned at an odd-numbered row are connected to a gate line $G_{i+1}$, e.g., an even-numbered gate line, and control terminals of writing switching elements Q31 and Q41 of the third pixel PX3 and the fourth pixel PX4, respectively, positioned at even-numbered rows are connected to a gate line $G_{i+2}$, e.g., an odd-numbered gate line.

Accordingly, in an odd-numbered frame, the writing switching elements Q31 and Q41 of the third pixel PX3 and the fourth pixel PX4, respectively, positioned at the even-numbered row are turned on by the gate signal shown in FIG. 4 and described above in greater detail with reference thereto, and the third pixel PX3 and the fourth pixel PX4 thereby receive a data voltage to display an image based on a luminance represented by a reference gray voltage of an image signal DAT. However, the first pixel PX1 and the second pixel PX2 positioned at the odd-numbered rows do not transmit light by the turned-on writing switching elements Q12 and Q22, respectively, and thereby display a black color.

In a temporally subsequent and adjacent even-numbered frame, switching elements Q11 and Q21 of the first pixel PX1 and the second pixel PX2, respectively, positioned at the odd-numbered row, are turned on by the gate signal shown in FIG. 6 and described in greater detail above, and the first pixel PX1 and the second pixel PX2 receive a data voltage to display an image based on a luminance represented by a reference gray voltage of the image signal DAT. However, the third pixel PX3 and the fourth pixel PX4 positioned at the even-numbered row do not transmit light by the turned-on erasing switching elements Q32 and Q42, respectively, and thereby display a black color.

Thus, the liquid crystal display according to an alternative exemplary embodiment of the present invention discharges a data voltage of a pixel PX in which an image based on a data voltage applied from a current frame is displayed in a subsequent frame and thus displays a black color, thereby substantially reducing and/or effectively preventing a blur phenomenon generated by the stored image.

It will be noted that the exemplary embodiments of the present invention as described herein can be applied to other types of display devices such as an organic light emitting diode display, for example, as well as a liquid crystal display. Further, alternative exemplary embodiments of the present invention are not limited thereto.

Thus, according to an exemplary embodiment of the present invention, a pixel in which an image based on a data voltage applied in a current frame is displayed is discharged in a temporally subsequent and adjacent frame, thus displaying a black color in the temporally subsequent and adjacent frame, thereby substantially reducing and/or effectively eliminating a blur phenomenon generated by the stored image in the temporally subsequent and adjacent frame.

In addition, the blur phenomenon is effectively eliminated and, to that end, a duration time of a gate-on voltage can be set to be relatively long, even when a vertical synchronization signal has a high frequency.

According to exemplary embodiments of the present invention as described herein, a display device and a method of driving the same having advantages which include, but are not limited to, preventing a blur phenomenon from generating on a screen of the display device.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes or modifications in form and details may be made therein without departing from the spirit or scope of the present invention as defined by the following claims.

What is claimed is:

1. A display device comprising:

a first pixel;

a second pixel adjacent to the first pixel;

a first gate line which transfers a first gate-on voltage to the first pixel and the second pixel in a first frame, and only transfers a gate-off voltage to the first pixel and the second pixel in a second frame chronologically subsequent and adjacent to the first frame;

a second gate line which transfers a second gate-on voltage to the first pixel and the second pixel in the second frame, and only transfers a gate-off voltage to the first pixel and the second pixel in the first frame;

a first data line which transfers a first data voltage to the first pixel in the second frame; and a second data line which transfers a second data voltage to the second pixel in the first frame, wherein the first pixel stores the first data voltage as a first stored data voltage in response to the second gate-on voltage and discharges the first stored data voltage in response to the first gate-on voltage, and the second pixel stores the second data voltage as a second stored data voltage in response to the first gate-on voltage and discharges the second stored data voltage in response to the second gate-on voltage, wherein the stored data in the first frame is maintained until the stored data is discharged in the second frame.

2. The display device of claim 1, further comprising:

a plurality of first gate lines;

a plurality of second gate lines; and a display panel on which the plurality of first gate lines and the plurality of second gate lines are disposed, wherein first gate lines of the plurality of first gate lines and second gate lines of the plurality of second gate lines are disposed on the display panel in alternating positions.

3. The display device of claim 2, further comprising:

a plurality of first pixels disposed on the display substrate; and a plurality of second pixels disposed on the display substrate, wherein first pixels of the plurality of first pixels and second pixels of the plurality of second pixels are arranged in a matrix pattern, and the first pixels and the second pixels are arranged alternately in both a row direction and in a column direction on the display substrate.

4. The display device of claim 2, further comprising:

a plurality of first pixels disposed on the display substrate; and a plurality of second pixels disposed on the display substrate, wherein first pixels of the plurality of first pixels and second pixels of the plurality of second pixels are arranged alternately in a row direction.

5. The display device of claim 1, wherein one of the first pixel and the second pixel comprises:

a first switching element which transfers one of the first data voltage and the second data voltage in response to one of the first gate-on voltage and the second gate-on voltage;

a capacitor which stores the one of the first data voltage and the second data voltage transferred from the first switching element; and a second switching element which discharges the one of the first data voltage and the second data voltage stored in the capacitor in response to one of the second gate-on voltage and the first gate-on voltage.

6. The display device of claim 5, wherein the capacitor comprises:

a pixel electrode which receives the one of the first data voltage and the second data voltage from the first switching element;

a common electrode which receives a common voltage; and a liquid crystal layer formed between the pixel electrode and the common electrode.

7. The display device of claim 6, wherein the second switching element comprises a first terminal connected to the pixel electrode and a second terminal which receives the common voltage.

8. The display device of claim 6, wherein the second switching element comprises a first terminal connected to the pixel electrode and a second terminal connected to the common electrode.

9. The display device of claim 6, wherein the one of the first pixel and the second pixel further comprises a signal line, the signal line and the pixel electrode forming the capacitor, and the second switching element comprises a first terminal connected to the pixel electrode and a second terminal connected to the signal line.

10. The display device of claim 1, wherein the first frame and the second frame are alternately repeated.

11. A display device comprising:

a first pixel and a second pixel;

a first gate line which transfers a first gate-on voltage to the first pixel and the second pixel in a first frame, and only transfers a gate-off voltage to the first pixel and the second pixel in a second frame chronologically subsequent and adjacent to the first frame;

a second gate line which transfers a second gate-on voltage to the first pixel and the second pixel in the second frame, and only transfers a gate-off voltage to the first pixel and the second pixel in the first frame;

a first data line which transfers a first data voltage to the first pixel in the second frame; and a first data line which transfers a first data voltage to the first pixel in the second frame;

a second data line which transfers a second data voltage to the second pixel in the first frame, wherein the first pixel represents a gray voltage level corresponding to the first data voltage in response to the second gate-on voltage and represents a black voltage level in response to the first gate-on voltage, and the second pixel which represents the gray voltage level corresponding to the second data voltage in response to the first gate-on voltage and represents the black voltage level in response to the second gate-on voltage, wherein the stored data in the first frame is maintained until the stored data is discharged in the second frame.

12. The display device of claim 11, wherein:

the first pixel comprises:

a first switching element including a control terminal connected to the second gate line, a first terminal connected to the first data line and a second terminal;

a first pixel electrode connected to the second terminal of the first switching element;

a first common electrode to which a common voltage is applied; and a second switching element including a control terminal connected to the first gate line, a first terminal connected to the pixel electrode, and a second terminal which receives the common voltage, and the second pixel comprises:

a third switching element including a control terminal connected to the first gate line, a first terminal connected to the second data line and a second terminal;

a second pixel electrode connected to the second terminal of the third switching element;

a second common electrode to which the common voltage is applied; and a fourth switching element including a control terminal connected to the second gate line, a first terminal connected to the second pixel electrode and a second terminal which receives the common voltage.

13. The display device of claim 12, wherein the second terminal of the second switching element is connected to the first common electrode, and the second terminal of the fourth switching element is connected to the second common electrode.

14. The display device of claim 12, wherein the first pixel further comprises a first signal line, the first signal line and the first pixel electrode forming a storage capacitor, the second terminal of the second switching element is connected to the signal line;

the second pixel further comprises a second signal line, the second signal line and the second pixel electrode forming a storage capacitor, and the second terminal of the fourth switching element is connected to the second signal line.

15. The display device of claim 11, further comprising:

a third pixel and a fourth pixel; and a third gate line which transfers a third gate-on voltage to at least one of the third pixel and the fourth pixel in the first frame, wherein the third pixel represents a gray voltage level corresponding to the first data voltage in response to the third gate-on voltage and represents a black voltage level in response to the second gate-on voltage; and the fourth pixel represents a gray voltage level corresponding to the second data voltage in response to the second gate-on voltage and represents a black voltage level in response to the third gate-on voltage.

16. The display device of claim 15, wherein the second gate line is formed between the first gate line and third gate line.

17. The display device of claim 11, wherein the first frame and the second frame are alternately repeated.

18. A method of driving a display device comprising a first pixel, a second pixel, a third pixel and a fourth pixel arranged in a matrix form, the method comprising:

outputting a first gate-on voltage via a first gate line to the first pixel, the second pixel, the third pixel and the fourth pixel in a first frame;

outputting only a gate-off voltage via a second gate line to the first pixel, the second pixel, the third pixel and the fourth pixel in the first frame;

storing data in the second pixel and the third pixel in response to the first gate-on voltage;

discharging data stored in the first pixel and the fourth pixel in response to the first gate-on voltage;

displaying an image corresponding to data stored in the second pixels and the third pixel;

outputting a second gate-on voltage via the second gate line to the first pixel, the second pixel, the third pixel and the fourth pixel in a second frame chronologically subsequent and adjacent to the first frame;

outputting only a gate-off voltage via the first gate line to the first pixel, the second pixel, the third pixel and the fourth pixel in the second frame;

storing data in the first pixel and the fourth pixel in response to the second gate-on voltage;

discharging data stored in the second pixel and the third pixel in response to the second gate-on voltage; and displaying an image corresponding to data stored in the first pixel and the fourth pixel, wherein the stored data in the first frame is maintained until the stored data is discharged in the second frame.

19. The method of claim 18, wherein the display device further comprises:

a plurality of first pixels;

a plurality of second pixels;

a plurality of third pixels; and a plurality of fourth pixels, wherein first pixels of the plurality of first pixel and third pixels of the plurality of third pixel are arranged in an alternating manner in a column direction, and second pixels of the plurality of second pixel and fourth pixels of the plurality of fourth pixel are arranged in an alternating manner in a column direction.

20. The method of claim 19, wherein the first pixel and the second pixel are arranged in an alternating manner in a row direction, and the third pixel and the fourth pixel are arranged in an alternating manner in a row direction.

21. The method of claim 18, wherein the first frame and the second frame are alternately repeated.

* * * * *